United States Patent [19]

Wooldridge

[11] 4,325,714

[45] Apr. 20, 1982

[54] MOUNTING ARRANGEMENT FOR ELECTROSTATIC PRECIPITATOR

[75] Inventor: James E. Wooldridge, Louisville, Ky.

[73] Assignee: Allis-Chalmers Corporation, Milwaukee, Wis.

[21] Appl. No.: 222,039

[22] Filed: Jan. 2, 1981

[51] Int. Cl.[3] ..... B03C 3/08; B03C 3/12

[52] U.S. Cl. ..... 55/143; 55/145

[58] Field of Search ..... 55/140, 141, 143, 145, 55/147, 496, 506, 478

[56] References Cited

U.S. PATENT DOCUMENTS

| | | | |
|---|---|---|---|
| 3,016,980 | 1/1962 | Gonzalez | 55/137 |
| 3,041,807 | 7/1962 | Getzin et al. | 55/143 |
| 3,540,191 | 11/1970 | Herman | 55/145 |
| 3,836,135 | 9/1974 | Wightman | 55/143 |
| 3,856,491 | 12/1974 | Dietrich | 55/478 |

FOREIGN PATENT DOCUMENTS

| | | | |
|---|---|---|---|
| 438439 | 2/1975 | U.S.S.R. | 55/141 |

*Primary Examiner*—David L. Lacey

*Attorney, Agent, or Firm*—Thomas G. Anderson

[57] ABSTRACT

A mounting arrangement for securing electrode plate assemblies in an electrostatic precipitator. The arrangement includes an adjustable, grid-like mounting frame adapted to be secured across the interior of the precipitator housing and a pin and slot attachment arrangement for releasably securing each of the plate assemblies to the frame.

6 Claims, 3 Drawing Figures

MOUNTING ARRANGEMENT FOR ELECTROSTATIC PRECIPITATOR

BACKGROUND OF THE INVENTION

1. Field of Invention

This invention relates to electrostatic precipitators and in particular to an arrangement for supporting electrode plate assemblies in an electrostatic precipitator.

2. Background of the Invention

The prior art discloses a variety of arrangements for supporting electrode plate assemblies within the housing of an electrostatic precipitator. For example, U.S. Pat. No. 3,041,807 shows a supporting arrangement wherein each of its electrode plate assemblies is supported on a pair of tracks or brackets cantilevered from a corresponding pair of vertically extending support members. In that arrangement, each of the plate assemblies are first slid into place on the brackets and then secured in position by a pair of retaining members which are threaded on the distal ends of each of the brackets. While this type of arrangement is relatively lightweight and easy to assemble, experience has shown that corrosion often causes the plate assemblies to bond to the brackets after extended use so that it is necessary for a workman to pry each of the assemblies away from the vertical support members and out of the brackets with a crowbar or the like. As a result, both the brackets and the electrode plates are often bent or otherwise damaged during routine servicing and inspection of the electrode assemblies. Moreover, since the cantilevered brackets tend to sag under the weight of the plate assemblies, it can be a difficult and time consuming task for an untrained workman to install and remove the individual assemblies without damaging the plate assemblies.

SUMMARY OF THE INVENTION

The present invention relates to electrostatic precipitators for removing particulates from a dirty gas stream and in particular to an arrangement for releasably supporting one or more electrode plate assemblies in the gas stream flowing through the housing of the precipitator.

The arrangement includes a mounting frame for the electrode plate assemblies adapted to be secured across the interior of the precipitator housing. Preferably, the mounting frame is of a grid-like configuration having a plurality of openings so that a plurality of electrode plate assemblies can be secured to it in vertically and laterally adjacent relation. The invention provides for securing opposing pairs of the plate assemblies on the upstream and downstream sides of the mounting frame by utilizing key and slot arrangements which suspend each opposing pair of the plate assemblies in flow-through alignment with one of the openings in the frame. The mounting frame also includes a pair of sizing members extending along the length of two adjacent legs of the frame. This allows a workman to easily size the outer periphery of the frame to the shape of the interior of the housing so as to substantially simplify its installation in the field as well as provide an effective seal between the outer periphery of the frame and the walls of the housing.

It can be seen that the supporting arrangement embodying the invention is of a relatively lightweight and durable design which is easy to assemble and service in the field. However, it is to be understood that various changes can be made in the arrangement, form and construction of the apparatus disclosed herein without departing from the spirit and scope of the invention.

DESCRIPTION OF THE PREFERRED EMBODIMENT

Figures 1, 2, 3:
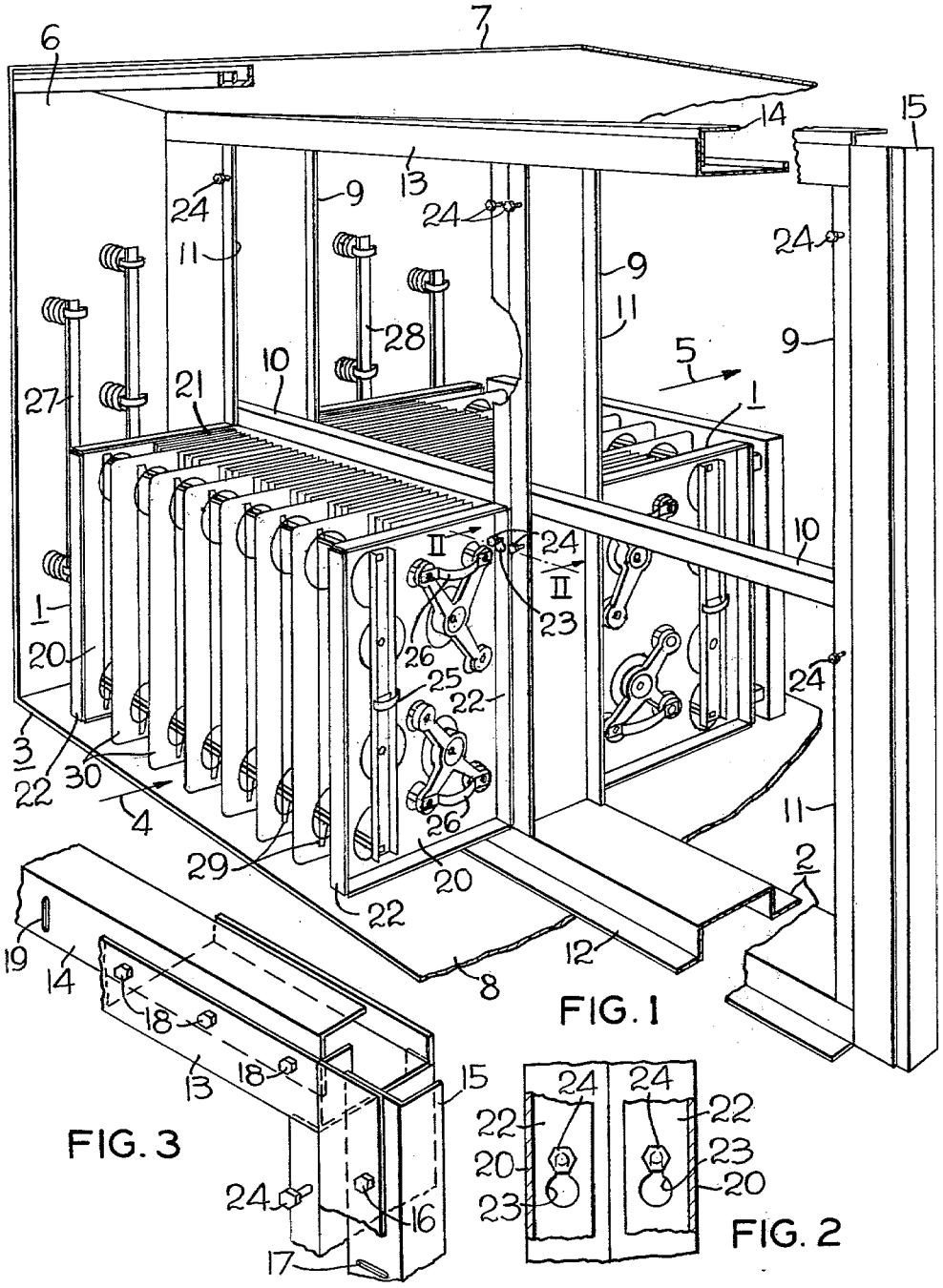
FIG. 1 is a partial perspective view showing one of the opposing pairs of electrode plate assemblies secured to the mounting frame within the precipitator housing.
FIG. 2 is a vertical sectional view taken substantially along line II—II in FIG. 1.
FIG. 3 is a partial perspective view showing the connection between the sizing members and the mounting frame.

Referring to the drawings, there is shown a pair of opposing electrode plate assemblies or units 1 secured to a grid-like mounting frame 2 secured across the housing 3 of an electrostatic precipitator having a gas inlet 4 and a gas outlet 5 for directing a gas stream through the precipitator.

As shown in the drawings, the housing 3 includes spaced and facing side walls 6, top wall 7 and bottom wall 8 to which the mounting frame 2 is secured by bolts or the like as will be described. The grid-like mounting frame 2, which can be of a welded or bolted construction, includes a plurality of spaced channel-shaped members 9 extending vertically within the housing 3 which are interconnected by baffles 10 formed of rigid angle sections to define a plurality of openings 11 in the frame. The lower ends of the channel members 9 are secured to a hat-shaped channel member 12 extending across the bottom of the housing 3 and the upper ends of the channel members 9 are secured to an upwardly opening channel member 13 which extends across the top of the housing 3. In order to accommodate sizing of the outer periphery of the frame 2 to conform to the shape of the interior of the housing 3, a pair of adjustable sizing members 14 and 15 are secured to the upper channel member 13 and to the channel member 9 on the right side of the frame 2. As shown in FIG. 3, the sizing member 15 is an angle section which is secured to a similar angle section secured to the channel member 9 on the right side of the frame by a plurality of bolts 16 extending through the slots 17 in the sizing member 15, and similarly, the sizing member 14 is secured to the upper channel member 13 by the bolts 18 extending through the slots 19. From the foregoing, it can be seen that when installing the mounting frame 2 in the housing 3, a workman first positions it in the housing as shown in the drawings and then moves the sizing members 14 and 15 into engagement with the top wall 7 and the side wall 6 whereafter he tightens the bolts 16 and 18 to retain the sizing members in position. Thereafter, the sizing members 14 and 15, the hat-shaped channel member 12, and the channel member 9 on the left side of frame are affixed by suitable bolts or the like to the walls of the housing to secure the frame within the precipitator.

Each of the electrode plate assemblies 1 includes a pair of spaced end panels 20 which carry the discharge electrodes 29 on the ionizing zone of the assembly and the charged plates 21 and grounded plates 30 in the collecting zone of the assembly such as in the plate assembly shown in U.S. Pat. No. 3,016,980. The end panels 20, which are preferably formed from sheet metal, each include a peripheral flange 22 which is adapted to abut one of the vertical channel members 9 when the plate assembly is secured to the mounting frame. As shown in FIG. 2, a keyhole-shaped slot 23 is provided in the flanges 22 of each of the end panels 20 which is sized to receive one of the hangers or pins 24 projecting from the frame 2. The slots 23 are located proximate the upper edge of the flanges 22 and are adapted to receive and entrap the enlarged heads of a corresponding pair of the pins 24 projecting from the mounting frame 2 adjacent each of the openings 11 to engage and secure the plate assembly to the mounting frame. In this regard, it should be noted that the invention also provides for an array of pins 24 projecting from the downstream side of the mounting frame 2 which is identical to the array of pins projecting from the upstream side of the frame to facilitate securing the plate assemblies 1 on both sides of the frame as shown in the drawings, or on only one side of the frame as may be desired.

Although for purposes of illustration only one pair of opposing electrode plate assemblies 1 is shown in the drawings, it is to be understood that a pair of plate assemblies is to be secured over each of the frame openings 11 to form horizontal rows of side-by-side plate assemblies which are electrically interconnected for maintaining the charge on the discharge electrodes 29 and the charged plates 21 during operation of the precipitator. More particularly, each of the end panels 20 includes insulated electrical contacts 25 and 26 which mate or abut identical contacts on its adjacent plate assemblies to conduct the desired electrical charge to the adjacent assemblies, it being noted that the electrical contacts 25 and 26 on the outer plate assembly 1 shown on the left side of FIG. 1 mate with electrical contacts 27 and 28 on the wall 6 which are connected to suitable electrical power sources.

From the foregoing, it can be seen that an entire bank of the electrode plate assemblies can be quickly and easily installed on the mounting frame by simply aligning each of the assemblies over its respective opening in the frame and hanging it on the two pins projecting from the frame on the sides of the opening. When it is desired to remove one of the assemblies, the workman lifts the assembly until the enlarged portions of the keyhole-shaped slots are aligned with the heads of the pins and pulls the assembly away from the frame.

The embodiments of the invention in which an exclusive property or privilege is claimed are defined as follows:

1. In an electrical precipitator for removing particulate materials from a dirty gas stream including a housing having an upstream gas inlet and a downstream gas outlet for the gas stream flowing through the precipitator, the improvement comprising:

electrode plate assembly means;

mounting means for supporting said electrode plate assembly means within the precipitator spanning the interior of the housing across the dirty gas stream, said mounting means having an opening accommodating gas flow through the precipitator between the gas inlet and the gas outlet;

a pair of pins projecting from said mounting means on opposite sides of the opening; and a pair of slots in said plate assembly means receiving said pins to suspend the plate assembly means in flow-through alignment with the opening.

2. The precipitator according to claim 1, and said electrode plate assembly means including a first electrode plate assembly unit on one side of said mounting means and a second electrode plate assembly unit aligned with said first unit on the other side of the mounting means.

3. The precipitator according to claim 1, and said mounting means including a plurality of spaced support beams spanning the interior of the precipitator across the dirty gas stream and a plurality of spaced baffle members interconnecting said beams to form a grid having a plurality of openings for the gas stream flowing through the precipitator; and said electrode plate assembly means including a plurality of electrode plate assembly units, each of said units being secured to the mounting frame in flow-through alignment with one of said plurality of openings.

4. The precipitator according to claim 3, and said electrode plate assembly units being disposed in adjacent side-by-side relation; and each of said units having electrical contact members positioned to engage with electrical contact members on the unit adjacent thereto.

5. In an electrical precipitator for removing particulate materials from a dirty gas stream including a housing having an upstream gas inlet and a downstream gas outlet for the gas stream flowing through the precipitator, the improvement comprising:

electrode plate assembly means;

mounting means for supporting said electrode plate assembly means within the precipitator spanning the interior of the housing across the dirty gas stream, said mounting means having an opening accommodating gas flow through the precipitator between the gas inlet and the gas outlet;

hanger means and receiving means cooperatively receiving said hanger means to removably secure said electrode plate assembly means to said mouting means and to suspend said electrode plate assembly in flow-through alignment with said opening;

said mounting means having an outer frame of a generally rectangular configuration sized to be generally contiguous with the interior periphery of the housing;

a pair of sizing members extending along the lengths of two adjacent legs of said frame engaging the interior peripheral wall of said housing to align the frame within the housing; and each of said sizing members being releasably secured to the frame to accommodate selective positioning of the sizing member with respect to the frame.

6. The precipitator according to claim 5, and said sizing members being releasably secured to the frame by bolt and slot fastening means.

* * * * *